US007870937B1

(12) United States Patent
Arnao

(10) Patent No.: US 7,870,937 B1
(45) Date of Patent: Jan. 18, 2011

(54) COMBINATION LUGGAGE AND COMPUTER WORKSTATION

(76) Inventor: Albert Arnao, 5615 San Juan Ave. #202, Jacksonville, FL (US) 32210

( * ) Notice: Subject to any disclaimer, the term of this patent is extended or adjusted under 35 U.S.C. 154(b) by 206 days.

(21) Appl. No.: 11/725,276

(22) Filed: Mar. 19, 2007

(51) Int. Cl.
*A45C 9/00* (2006.01)

(52) U.S. Cl. ..... 190/1; 190/11; 190/15.1; 206/320

(58) Field of Classification Search ..... 206/320; 190/11, 15.1, 10, 14, 1, 13 H; 280/47.35, 280/47.29, 37
See application file for complete search history.

(56) References Cited

U.S. PATENT DOCUMENTS

| | | | | | |
|---|---|---|---|---|---|
| 1,510,736 | A | * | 10/1924 | Brown | 190/14 |
| 2,268,364 | A | * | 12/1941 | White et al. | 206/362 |
| 3,960,252 | A | * | 6/1976 | Cassimally | 190/18 A |
| 4,515,493 | A | | 5/1985 | Radovich | |
| 4,966,258 | A | * | 10/1990 | Hawley | 190/4 |
| 5,002,293 | A | * | 3/1991 | Gottselig | 280/47.35 |
| 5,010,988 | A | * | 4/1991 | Brown | 190/104 |
| 5,115,893 | A | | 5/1992 | Terkildsen | |
| 5,275,365 | A | * | 1/1994 | Gerbel et al. | 248/129 |
| D346,509 | S | | 5/1994 | Mezoe | |
| 5,452,908 | A | * | 9/1995 | Bencic | 280/47.35 |
| 5,529,322 | A | * | 6/1996 | Barton | 280/30 |
| 5,544,910 | A | * | 8/1996 | Esposito | 280/654 |
| 5,639,109 | A | * | 6/1997 | Liang | 280/655 |
| 5,676,223 | A | * | 10/1997 | Cunningham | 190/109 |
| 6,149,168 | A | * | 11/2000 | Pauser et al. | 280/47.371 |
| 6,213,267 | B1 | | 4/2001 | Miller | |
| 6,257,407 | B1 | | 7/2001 | Truwit et al. | |
| 6,471,019 | B1 | * | 10/2002 | Miller | 190/11 |
| 6,496,360 | B1 | | 12/2002 | Cordes et al. | |
| 6,543,796 | B1 | | 4/2003 | Johnson et al. | |
| 6,578,708 | B2 | * | 6/2003 | Barnett | 206/320 |
| 6,604,472 | B2 | | 8/2003 | McNeil | |
| 6,666,363 | B2 | * | 12/2003 | Godshaw et al. | 224/578 |
| 6,736,073 | B2 | * | 5/2004 | Ryburg | 108/42 |
| D493,283 | S | * | 7/2004 | Rada et al. | D3/279 |
| D503,536 | S | * | 4/2005 | Rada et al. | D3/321 |
| 7,021,436 | B2 | * | 4/2006 | Hoberman et al. | 190/18 R |
| 2002/0063072 | A1 | * | 5/2002 | Pham | 206/320 |
| 2002/0070532 | A1 | * | 6/2002 | Harrison et al. | 280/647 |
| 2002/0148693 | A1 | * | 10/2002 | Bauer | 190/108 |
| 2003/0006877 | A1 | * | 1/2003 | Anand | 338/320 |
| 2003/0024043 | A1 | * | 2/2003 | Rivera et al. | 4/654 |
| 2004/0226791 | A1 | * | 11/2004 | Levy | 190/11 |
| 2005/0279750 | A1 | * | 12/2005 | Barquist et al. | 220/629 |
| 2006/0076861 | A1 | * | 4/2006 | Baughman | 312/314 |
| 2007/0007094 | A1 | * | 1/2007 | Smith | 190/11 |
| 2007/0159781 | A1 | * | 7/2007 | Zbikowski | 361/683 |

* cited by examiner

*Primary Examiner*—Sue A Weaver
(74) *Attorney, Agent, or Firm*—Lawerence J. Gibney, Jr.

(57) ABSTRACT

This is a combination computer work station, cosmetic desk, casual/open tote and luggage set device. The device is easily transported and the area to push or pull luggage may be expanded to stow various pieces of luggage. Luggage may be partially filled yet secured by the divider device.

5 Claims, 5 Drawing Sheets

COMBINATION LUGGAGE AND COMPUTER WORKSTATION

BACKGROUND OF THE INVENTION

A. Field of the Invention

A new design for a complete set of luggage consisting of several new innovations to accomplish the following:

1. Provide a method whereby a traveler can easily carry and transport a complete set of luggage on a built in dolly that can either be pulled along or pushed.

2. Provide at a convenient table top length three configurations of a travelers tote/carry on bag as follows:

A. Lap top computer work station

B. Cosmetic case

C. Casual open tote

3. Provide an optional piece of luggage as a bulk files trunk with an adjustable area for personal items and or garments.

4. Provide a firm divider board for each piece of luggage that would avoid the necessity to "stuff" luggage full in order to prevent garments from shifting and wrinkling plus allowed saved space to accommodate extra items purchased during travel.

All of the above will provide the traveler with an easily transported set of luggage, a means to easily access and work at a lap top or have a cosmetic station or have personal items and travel documents easily accessible, carry bulk file, prevent garments from wrinkling and provide an accessory bag for those personal items usually held in your hands during down times.

B. Prior Art

The concept of combining a desk surface with luggage has been around for many years and patents, which address this idea are found in the prior art. A representative example of this type of device is Johnson, U.S. Pat. No. 6,543,796. The Johnson device seeks to combine a desk surface with a luggage carrier. Another example in the prior art which seeks to combine dual functions in one device can be found at McNeil, U.S. Pat. No. 6,604,472 and claims a laptop computer support table. Another reference is also found at Ryburg, U.S. Pat. No. 6,736,073.

Because this device will be used by a business traveler it is anticipated that certain desk materials should be included. An example of that type of device in the prior art can be found at Terkildsen, U.S. Pat. No. 5,115,893.

None of the prior art references however combine the many features that are found in this application.

BRIEF SUMMARY OF THE INVENTION

This device will allow the business traveler or anyone to easily transport a complete set of luggage and to easily perform computer functions while at the same time stowing one's carry on luggage. It will be a combination dolly transport system, computer workstation, cosmetic desk and an open/casual tote, with a luggage compartment. The items that may be carried in the luggage portion of the tote device will be as varied as the traveler.

The basic tote will have retractable or telescoping legs to expand downward and secure one side of a bottom surface of the unit and a series of supports to secure the other side of the bottom surface of the device. Because the bottom surface is retractable the bottom surface will rest flush against the bottom of the luggage piece.

Wheels or rollers on one end of the telescoping legs support one end of the bottom surface, and a plurality of swivel wheels or feet on the front side of the bottom surface ensures that the device, once it has been placed in position, remains level. The leveling feet may be replaced by front swivel wheels to provide a means to push or pull the device when luggage is stowed in the space between the bottom of the main piece of luggage and the bottom surface of the unit.

On the top of the piece of luggage will be several zippered compartments. Underneath the top zippered compartments will be a stowing space, which will stow an expandable and removable briefcase, laptop computer and a flip out work surface. Protective padding is also provided to ensure that the computer is not damaged during transit.

On the bottom surface will be a flat, planar surface on which various items, particularly luggage may be kept and stored. When the bottom surface of the device is expanded, several vertical support members will rotate upward from the support members on the bottom surface to locking ports on the underside of the device. These vertical support members will secure the device in position and will provide a space between the bottom of the luggage and the grill surface, which is on the flat planar surface. The flat, planar surface will be large enough to stow other pieces of luggage in that section.

On the front or around the perimeter of the luggage will be several other pockets in which to stow commonly transported items, for instance, pens and pencils, a phone pocket, and traveling documents. This compartment will be built on a rigid flip down flap that will also provide a computer mouse pad on the back side.

In order to carry the device, there will be a shoulder strap, which may be adjustable, a carrying handle on the top as well as a retractable handle on the back side.

It is an object of this device to enable a business traveler to have a level laptop and working (desk type) surface on which to work while at the same time easily transporting a complete set of his or her luggage. It is a further object to protect all necessary equipment, including the computer and delicate electronic equipment during transit.

DETAILED DESCRIPTION OF THE EMBODIMENTS

Figure 1:
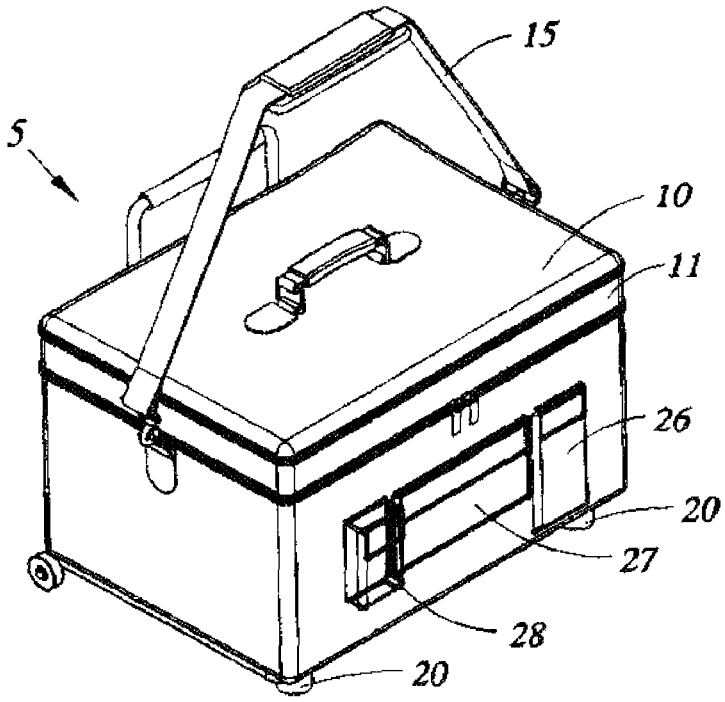
FIG. 1 is an isometric view of the device with the bottom flush against the bottom of the carrying case.

This is a device that will allow travelers to not only easily carry a complete set of luggage but also work at his or her computer during periods of down time, particularly in airports, courthouses, conference rooms and hotel rooms. It will be a complete set of luggage but will have several additional features.

The device 5 will be equipped with several ways to carry the device. One of the ways will be a shoulder strap 15, which is adjustable. The shoulder strap 15 is attached or secured to both sides of the device, on the ends. A carrying handle 30, which is located on the top surface of this device 5 will also be provided as an alternative means to carry the device. On one end of the device 5 will be a retractable handle 25, which is secured in tubes for that purpose.

On the bottom of the device 5 will be a set of rollers 35, which will allow the device 5 to be tilted backwards using the retractable handle 25, and pulled using the rollers 35. A variety of rollers 35 may be used but they should be sufficiently sturdy to support the weight that may be placed on the device 5.

Figure 4:
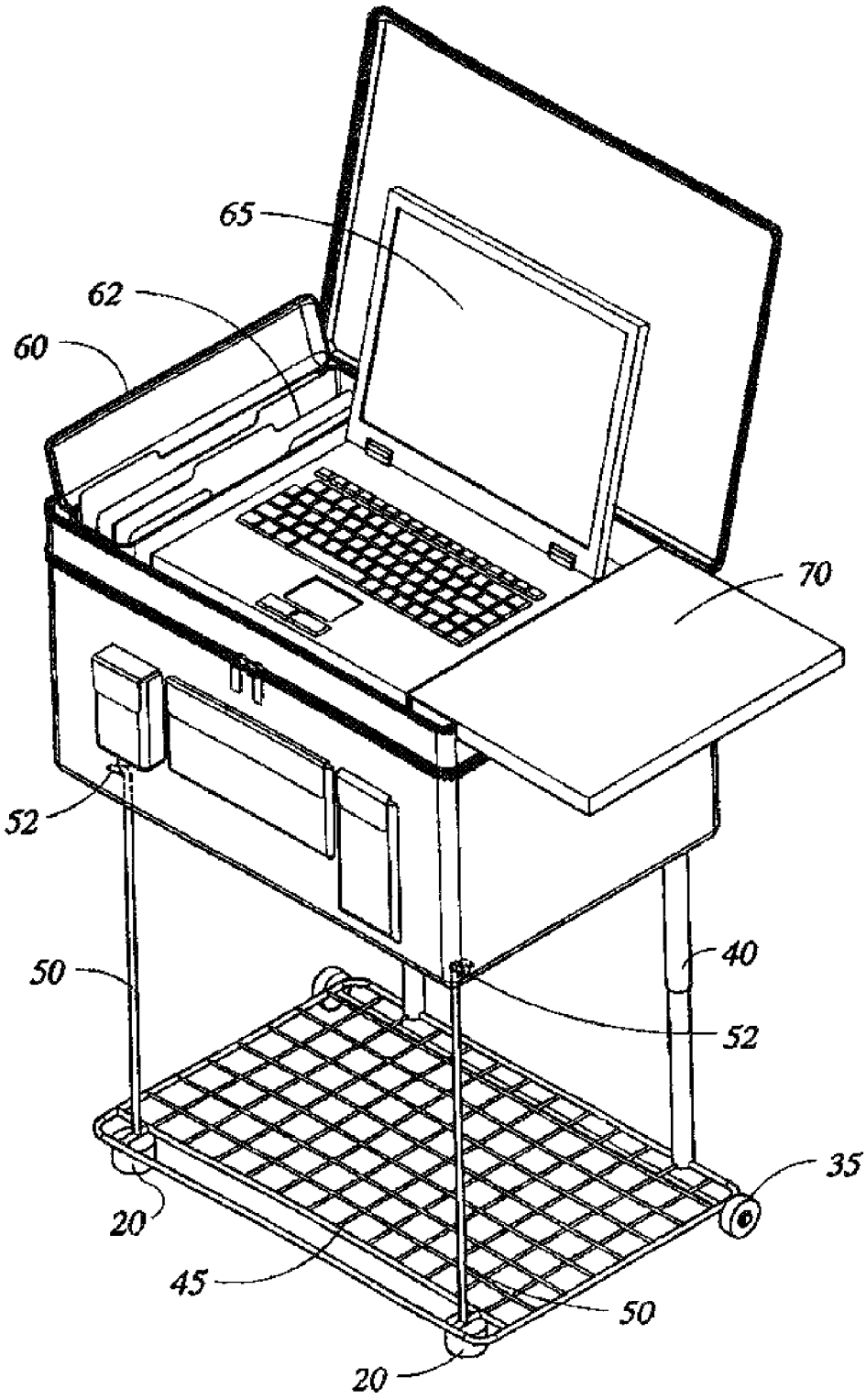
FIG. 4 is an isometric view of the device from the front with the grill in place and the work space and computer exposed.
Figure 5:
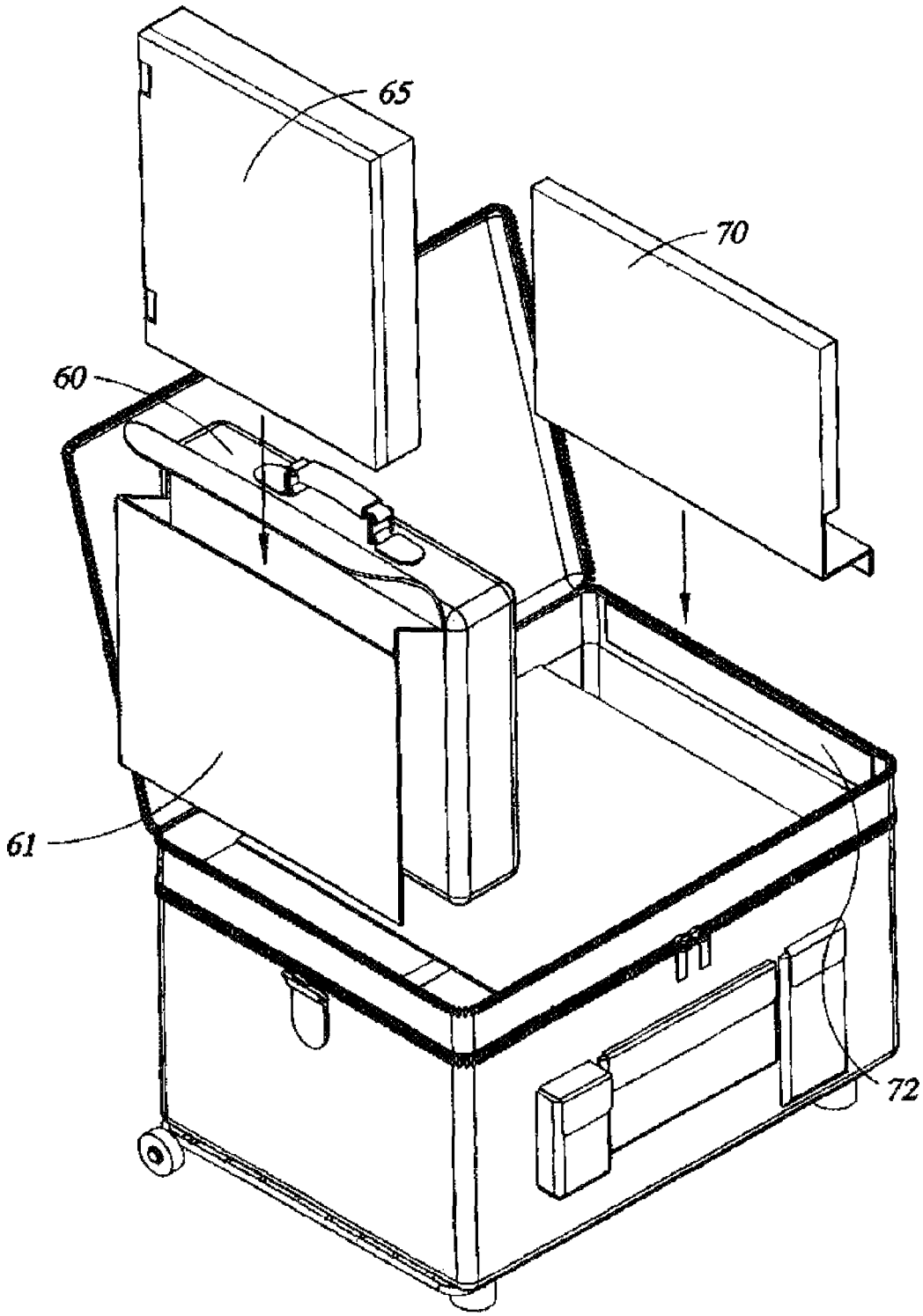
FIG. 5 is an isometric view of the front with the top zippered compartment open, showing the various storage spaces as well as work surfaces, briefcase lifted out of its' housing and expandable compartment to accommodate carrying the laptop within the briefcase.
Figure 6:
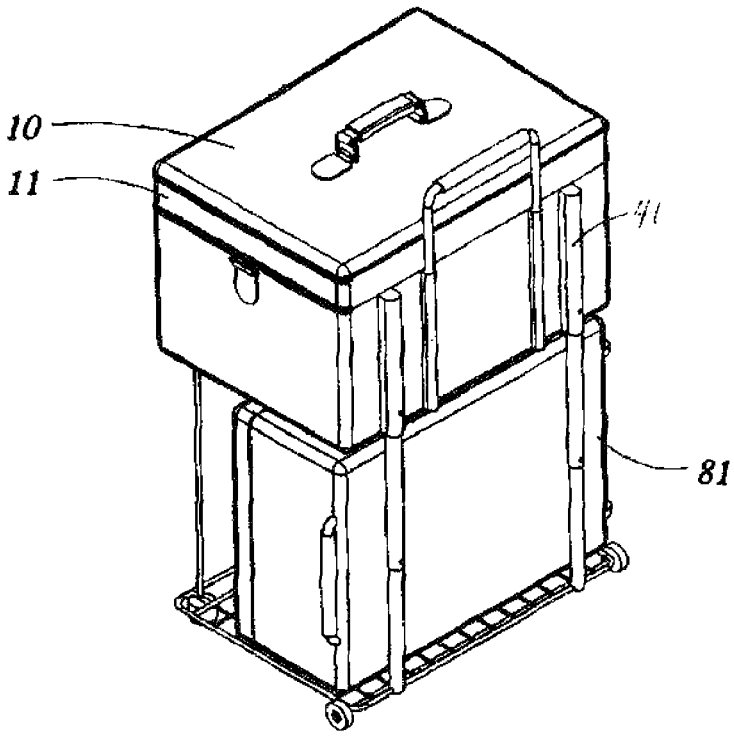
FIG. 6 is a depiction of the device stowing another piece of luggage on the grill member.
Figure 7:
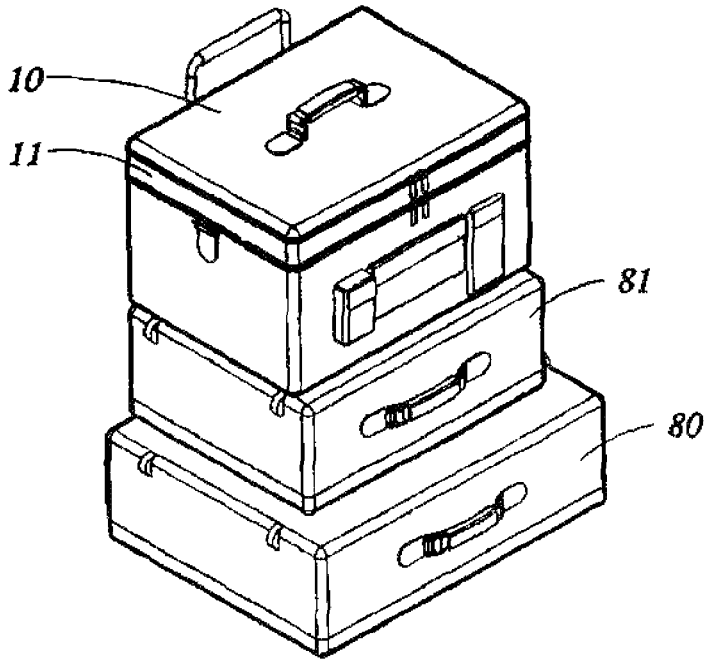
FIG. 7 is another depiction of the device storing multiple pieces of luggage on the grill member.

The rollers 35 will be secured to the outside edges of a bottom grill member 45. The grill member 45 is the approximate dimensions of the bottom of the device and will move up and down, as desired. The grill member 45 should be constructed to support the weight and size of other pieces of luggage such as depicted in FIGS. 6 and 7. This may require a double layer, flip out, or slide out extension to the grill member 45 to avoid larger pieces of luggage from tumbling off the grill member 45 (not depicted). On one end of the grill member 45 will be the rollers 35 and on the opposite end will be a set of leveling or swivel wheel devices 20. These leveling devices 20 could either be leveling feet as depicted in FIG. 4 or another set of swivel wheels. The purpose of the swivel wheels leveling device is to insure a flat, level work surface for the user of this device. If swivel wheels are used as the leveling members, flip-up bicycle type handles (not depicted) may also be positioned on either side of the piece of luggage to allow an individual to push the device as you would a grocery cart or airport rental luggage cart. With the bicycle handles would also be a soft material bag with loops on each end to hang over the bicycle handles that would hold items such as magazines, water bottles, toys, snacks, etc. used during down time (not depicted).

Near the leveling devices 20 will be a set of vertical supports 50, which are attached at one end to the grill member 45. When the grill member 45 is flush with the bottom of the device 5, the supports 50 are positioned parallel with the grill member 45. When the grill member 45 is fully expanded, the supports 50 will rotate upward from the grill member 45 and be perpendicular relative to the grill member 45. One end of the supports 50 will lock into support retainers 52, which are located on the bottom front of each end of the piece of luggage. The support retainers 52 insure that the supports 50 remain in position.

Figure 2:
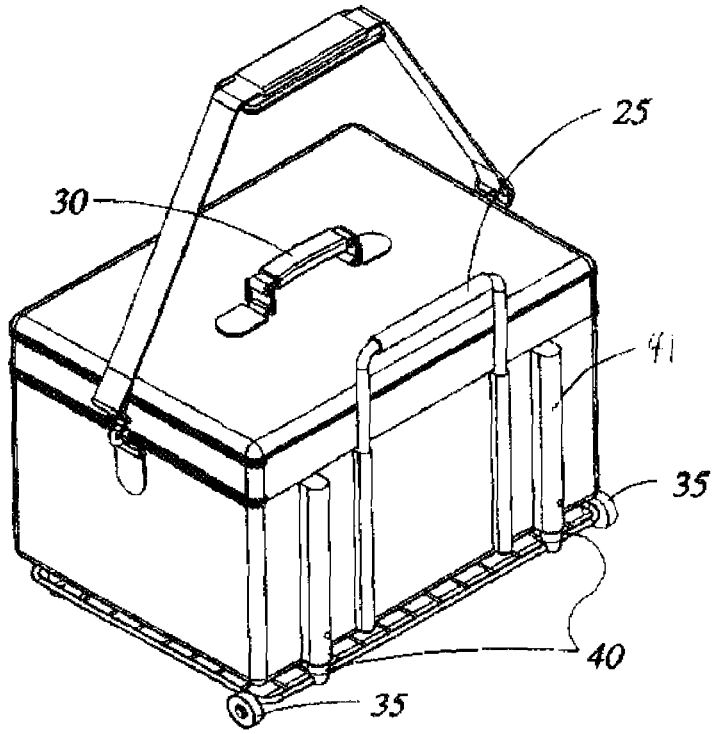
FIG. 2 is an isometric view from the rear of the device with the bottom of the device flush against the bottom of the carrying case.
Figure 3:
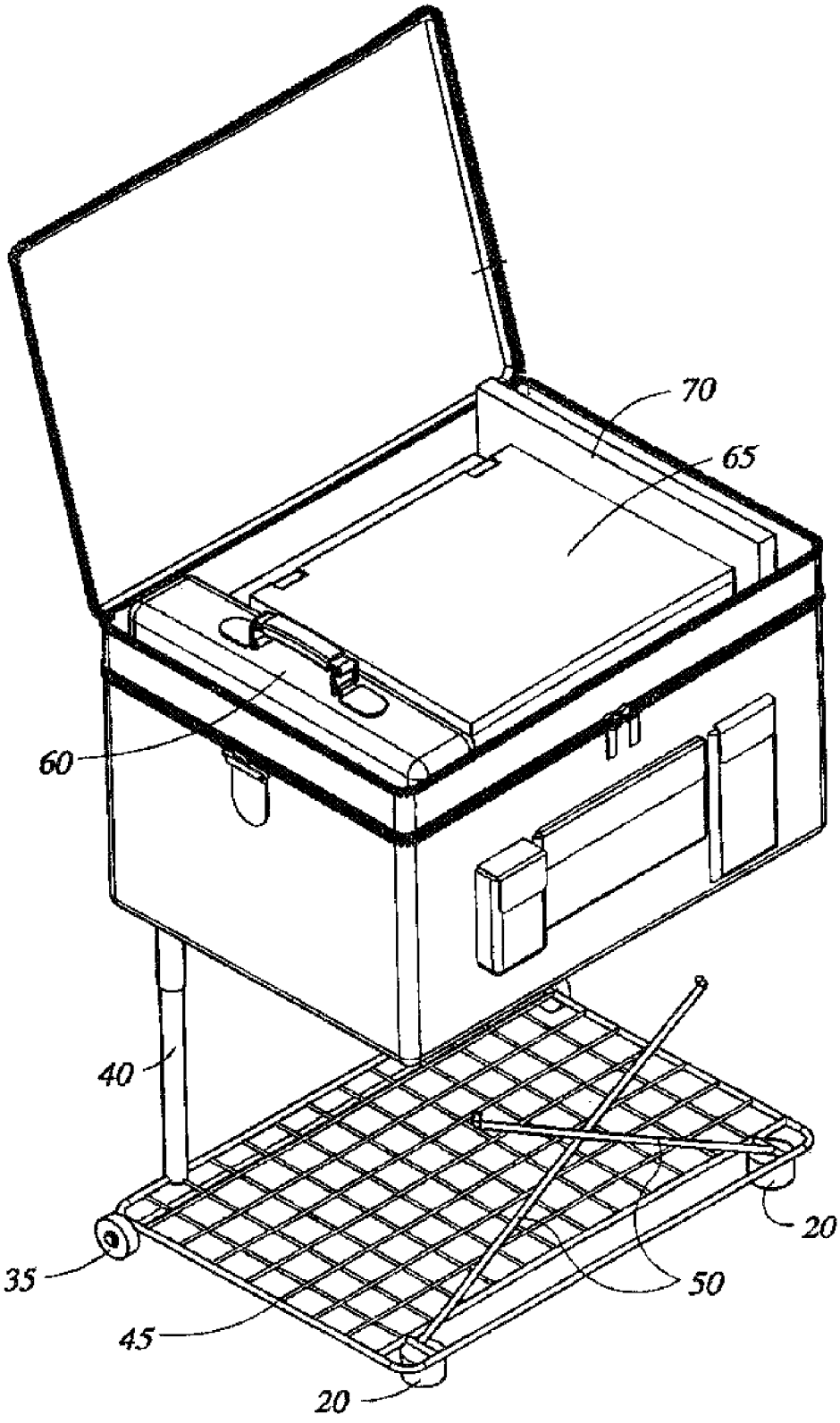
FIG. 3 is an isometric view from the front of the device depicting the grill on the device partially lowered.

On one end of the grill member 45 will be a pair of support members 40. These support members 40, which telescope when the grill member is lowered are housed in tubes 41 that are secured to the outside surface of the piece of luggage, one on each of the sides for the tubes for the telescoping handle 25 such as depicted in FIG. 2.

It is anticipated that the support retainers will be an indentation or a means to firmly secure this device to the bottom of the device.

On the front surface of the device 5 will be various pockets to stow items that are commonly used by the business traveler. This may be a pen and pencil pocket 26, a mobile phone pocket 28 or a traveling document pocket 27. Other types of pockets may be anticipated in addition to those specifically mentioned or specifically depicted in the drawings. These compartments will be on a firm or solid platform that folds down to provide a computer mouse storage.

In order to gain access to the computer and workstation, which is located in the center of the device, a zipper or other means of access will be provided. By opening the top cover 10 the computer will be exposed. A separate zipper will provide access to the storage area 11 for clothing.

On one side of the interior of the device will be a work surface 70, which is stowed in a compartment for that purpose inside the case. When the work surface 70 is pulled from the compartment it will rest roughly parallel to the ground and provide a surface on which to lay items. In the center of the interior will be a laptop computer 65. On the opposite side from the work surface 70 will be an opening for a briefcase 60 and other miscellaneous items such as files 62. The work surface 70 will be stowed in a cavity 72 for that purpose. The briefcase 60 may also have an expandable pocket for additional storage. The expandable computer pocket 61 on the briefcase 60 will also enable a laptop 65 to be stowed with the briefcase when the briefcase is carried separately as desired.

A variety of storage options and placement options are possible for the interior of the device in the area of the computer workstation. It is impossible to depict all possible storage arrangements but toiletry articles, small clothing items, etc. may be carried as a representative example.

In the lower part of the device 5 will be the area of the device to stow clothing, toilet articles and other items that are routinely taken by the traveler. Another set of zippers controls access to this area.

This device enables a computer workstation to be stored with this device. Because of the ability of the grill member 45 and telescoping legs 40 to move downward, adequate height is provided that various pieces of luggage may be stowed and transported with one device.

When the grill member 45 is fully extended such as shown in FIG. 6 another piece of luggage 81 may be stowed in the area between the bottom surface of the piece of luggage. In another configuration to show the versatility of the device, two pieces of luggage 80, 81 may be stowed in the area between the bottom of the piece of luggage and the top of the grill member as depicted in FIG. 7.

The inventor claims:

1. A combination workspace and computer workstation and luggage compartment, which is comprised of:

a. a piece of luggage;

wherein the piece of luggage has a predetermined structure;

said piece of luggage has four defined sidewalls;

said piece of luggage has a defined bottom surface;

wherein a predetermined portion of the piece of luggage is a storage area for items of clothing;

wherein a means of access to the storage area is provided;

wherein a predetermined area of the interior of the piece of luggage stows a computer;

wherein a means of access of the piece of luggage is provided to access the computer;

wherein a grill member is provided on the bottom surface of the piece of luggage;

wherein said piece of luggage has a defined top;

wherein the top of the luggage compartment is hinged on one end and the contents of the interior of the luggage compartment can be accessed;

wherein a means to carry the combination workspace and computer workstation and luggage compartment is provided;

said means to carry is attached to a portion of the luggage;

wherein a means to push or pull the combination workspace and computer workstation and luggage compartment is provided;

said means to push or pull is attached to a portion of the piece of luggage;

wherein a plurality of leveling members is secured to a portion of a grill member;

b. the grill member;

said grill member is of a predetermined thickness;

said grill member is flat and planar;

said grill member is constructed to support the weight and size of luggage placed on it;

said grill member is secured to the outside surface of the piece of luggage;

c. a plurality of telescoping legs;

wherein the telescoping legs are provided to raise and lower the grill member;

wherein said telescoping legs are secured to the outside surface of the luggage;

d. a pair of vertical support members;

said vertical support members extend from the bottom surface of the luggage;

wherein the vertical support members have a first end and a second end;

said first end of the vertical support members is secured to the grill member;

said second end of the vertical support members fit in a support retainer;

wherein the support retainer is positioned on the bottom surface of the luggage;

e. storage pockets;

wherein a plurality of storage pockets is provided;

f. the computer space;

wherein the computer space provides an area to stow a flat work surface.

2. The combination and computer workstation and luggage compartment as described in claim 1 wherein the means to carry is a shoulder strap.

3. The combination workspace and computer workstation and luggage compartment as described in claim 1 wherein the means to carry is a carrying handle.

4. The combination workspace and computer workstation and luggage compartment as described in claim 1 wherein the means to push or pull is a retractable handle.

5. The combination workspace and computer workstation and luggage compartment as described in claim 1 wherein the support retainer is integral to bottom surface of the luggage.

* * * * *